United States Patent [19]

Songer et al.

[11] 4,122,474

[45] Oct. 24, 1978

[54] PHOTOCOPY DEVELOPING APPARATUS FOR DIAZO FILM

[75] Inventors: Larry Allen Songer, Schaumburg; Thomas Vernon DeRyke, Libertyville, both of Ill.

[73] Assignee: Addressograph-Multigraph Corporation, Los Angeles, Calif.

[21] Appl. No.: 745,622

[22] Filed: Nov. 29, 1976

[51] Int. Cl.[2] ..... G03D 7/00

[52] U.S. Cl. ..... 354/300; 354/299; 34/37; 34/155

[58] Field of Search ..... 354/299, 300; 34/37, 34/122, 155, 234

[56] References Cited

U.S. PATENT DOCUMENTS

| | | | |
|---|---|---|---|
| 2,475,165 | 7/1949 | Trump | 34/234 |
| 2,630,744 | 3/1953 | Wilde | 34/234 |
| 2,761,364 | 9/1956 | Cross | 34/234 |
| 2,895,397 | 7/1959 | Hurlbut | 34/234 |
| 3,915,708 | 11/1975 | Zausmer et al. | 354/300 |

FOREIGN PATENT DOCUMENTS

| | | | |
|---|---|---|---|
| 695,188 | 8/1953 | United Kingdom | 354/300 |

*Primary Examiner*—L. T. Hix
*Assistant Examiner*—Alan Mathews
*Attorney, Agent, or Firm*—Michael A. Kondzella

[57] ABSTRACT

An apparatus for developing diazotype copy sheets is provided and comprises a duct element having an ingress and an egress end, a distribution element having an ingress end and a closed end, a manifold at the ingress ends of the duct and the distribution elements and a heater element proximate the duct element. All of the elements are enclosed within a developer tank provided with a perforated section adjacent a copy sheet developing station. Aqueous ammonia is supplied to the ingress end of the duct element and travels in a first path by gravity towards the egress end thereof. In its travel in the first path the aqueous ammonia is vaporized by the heater element thereby causing separation of the aqueous ammonia into a first portion of residue water comprising hot water and a trace of ammonia, and a second portion comprising ammonia gas and steam. The first portion exits from the egress end of the duct element to a waste eliminator device and the second portion travels in the opposite direction in the first path to the manifold which directs the second portion to the distribution element for travel in a second path. The second portion is expelled from ports provided in the distribution element to generate a gaseous ammonia atmosphere which passes through the perforated section of the developer tank and impinges upon a copy sheet to be developed at the developing station.

12 Claims, 5 Drawing Figures

PHOTOCOPY DEVELOPING APPARATUS FOR DIAZO FILM

BACKGROUND OF THE INVENTION

In the photocopying art, a two-component diazotype light sensitive material or copy sheet, which has first been exposed to a light image, is developed to produce thereon an azo-dye image by bringing the copy sheet into contact with a humidified atmosphere of ammonia vapor or gas. The gaseous ammonia is produced by heating an ammonium hydroxide solution such as 26° Baume ammonia or by the use of anhydrous ammonia gas.

The construction of known copying equipment for developing copy sheets of this type involves the use of a gas chamber in which the ammonia vapor is generated directly from a tank containing aqueous ammonia, or the ammonia vapor is piped in from tanks of anhydrous ammonia which is admixed with water vapor generated within the gas chamber. The gas producing instrumentalities usually call for circulatory pumping equipment which continually supplies fresh aqueous ammonia and/or anhydrous gas into the chamber maintaining the chamber in a state of readiness to receive the copy sheets.

Photocopying machines relying on the gas developing process as a means for producing copies are desirable because the process is dry, obviating the need for bringing liquid materials into direct contact with the copy sheet for development. Also, such machines produce images of high density and are capable of developing copies at a rapid rate. However, while such developing apparatuses and systems have been generally satisfactory there are certain shortcomings associated with the devices. In this regard, the prior art devices do not provide for consistent uniform control of the moisture content to which the copy sheet to be developed is exposed, for uniform control of the distribution of the gaseous ammonia within the developer tank and for utilization of substantially all of the ammonia gas contained in the aqueous ammonia.

One such prior art device is disclosed, for example, in U.S. Pat. No. 2,630,744 and comprises a developing chamber including an open trough sloped downwardly towards a discharge opening and an evaporator pipe positioned above the trough provided with perforations for expelling ammonia gas from the pipe. Aqueous ammonia is supplied to one end of the pipe. The pipe is formed such that its intermediate portion is lower than the ends of the pipe whereby a pool of aqueous ammonia is maintained therein.

The pool of aqueous ammonia is maintained in the pipe for evaporation of the ammonia gas from the aqueous ammonia, and the residue of water and a trace of ammonia gas are discharged from the other end of the pipe to the high end of the open trough. The water is evaporated as it flows downwardly in the trough to provide the moisture requirements in the developing chamber and the excess water exits through the discharge opening.

The evaporation of the aqueous ammonia in the pipe and the vaporization of the water in the trough are effected by a heating element which is formed to heat both the pipe and the residue in the trough. The aqueous ammonia in the pipe is heated to drive off ammonia gas which exits through the perforations in the pipe, and the residue is separately heated to drive off water vapor to satisfy the moisture requirements in the developing chamber.

Additionally, the prior art device includes a wick for feeding the aqueous ammonia through the pipe by capillary action and for providing a large surface for effecting evaporation of the aqueous ammonia while the residue thereof is discharged into the trough.

Because the device of the prior art evaporates the aqueous ammonia in and discharges both the ammonia gas and the residue from a common pipe, rather than at separate sources as in the present invention, the device is unable to provide control of the moisture quantity and uniform controlled distribution of the ammonia gas. Thus, because the aqueous ammonia cannot be heated uniformily throughout the length of the pipe, the amount of gaseous ammonia evaporated from the aqueous ammonia also varies from one section to another section of the pipe. Accordingly, the amount of gaseous ammonia expelled from the pipe also varies from section to section, thereby precluding uniform and controlled distribution of the gaseous ammonia from the pipe to the developing chamber.

Further, because the prior art device is unable to provide the proper moisture content solely by evaporating the aqueous ammonia, it necessitates the additional heating of the residue in the trough to vaporize the water therein in an attempt to satisfy the moisture requirements. However, the open trough is neither conducive to providing a controlled moisture quantity nor to uniform distribution of the moisture with the gaseous ammonia discharged from the pipe.

In the present invention, control of the moisture quantity, controlled distribution of the gaseous ammonia and almost complete utilization of the ammonia gas are attained as a result of confining aqueous ammonia flow and separation thereof into ammonia gas and residue waste to a first path, and confining flow and distribution of ammonia gas only to a second path.

Proper moisture content is obtained solely by evaporating the aqueous ammonia by heating the first path only to separate the aqueous ammonia into ammonia gas and residue waste. The residue waste is discharged from one end of the first path and the ammonia gas travels in the opposite direction and is directed from the other end of the first path to the second path. The ammonia gas entering the second path provides a consistently uniform moisture content, and the ammonia gas is discharged from the second path in a controlled manner such that no further vaporization of the residue or water is required to satisfy the moisture requirements within the developer tank.

SUMMARY OF THE INVENTION

The present invention relates to a developing apparatus for use with ammonia type diazo copying machines which overcomes the disadvantages of the prior art. The apparatus comprises a self-contained developer tank incorporating means for generating and controlling the moisture content to which a copy sheet to be developed is exposed, for uniformily distributing the gaseous ammonia within the developer tank to produce high quality diazo copies, and for utilizing substantially all of the ammonia gas contained in the aqueous ammonia.

The apparatus of the present invention comprises a substantially closed developer tank, having a perforated section adjacent a copy sheet developer station, for housing a duct element, a distribution element, a manifold and a heater element. The duct element includes an ingress end and an egress end and extends in a first path the length of the developer tank. The distribution element includes an ingress end and a closed end and extends in a second path substantially the length of the developer tank at a position above and spaced from the duct element. The manifold is positioned at the ingress ends of the duct and the distribution elements, and the heater element extends the length of the duct element at a position parallel to, below and closely spaced from the duct element.

Aqueous ammonia is pumped from a supply container to the ingress end of the duct element and travels by gravity towards the egress end thereof. In its travel through the duct element in the first path, the aqueous ammonia is vaporized by the heater element heating the duct element thereby causing separation of the aqueous ammonia into a first portion of residue waste and a second portion of ammonia gas. The first portion exits by gravity from the egress end of the duct element to a waste eliminator device and the second portion is caused to travel back towards the ingress end of the duct element whereat the manifold directs the second portion into a second path in the distribution element. A plurality of ports are provided in the distribution element for expelling the second portion therefrom for generating a controlled gaseous ammonia atmosphere within the developer tank. The gaseous ammonia atmosphere exits through the perforated section of the developer tank and impinges upon a copy sheet moved along the surface of the perforated section of the developer tank, under urging of an endless belt, while subjected to ammonia vapors emanating from the developer tank.

It is an object of the present invention to provide an improved apparatus for developing diazotype copy sheets with ammonia gas which provides for control of the moisture content to which the copy sheet to be developed is exposed to thereby produce copies having images of high density.

Another object of the invention is to provide an apparatus which provides for consistent, controlled and uniform distribution of the gaseous ammonia within the developer tank.

A further object of the invention is to provide an apparatus for developing diazotype materials in which the ammonia gas contained in the aqueous ammonia is utilized almost completely in the development of the copying material, thereby reducing ammonia waste and the cost associated therewith.

A feature of the invention is to provide a developing apparatus which is reliable in use, relatively simple in construction and inexpensive to manufacture.

Other objects, features and advantages of the invention will appear hereinafter as the description proceeds.

IN THE DRAWINGS

DESCRIPTION OF THE PREFERRED EMBODIMENT

While the apparatus of the present invention, with minor modifications, may be utilized for developing copy sheets with anhydrous ammonia, it will be described herein as used with ammonium hydroxide solution or aqueous ammonia.

Figure 1:
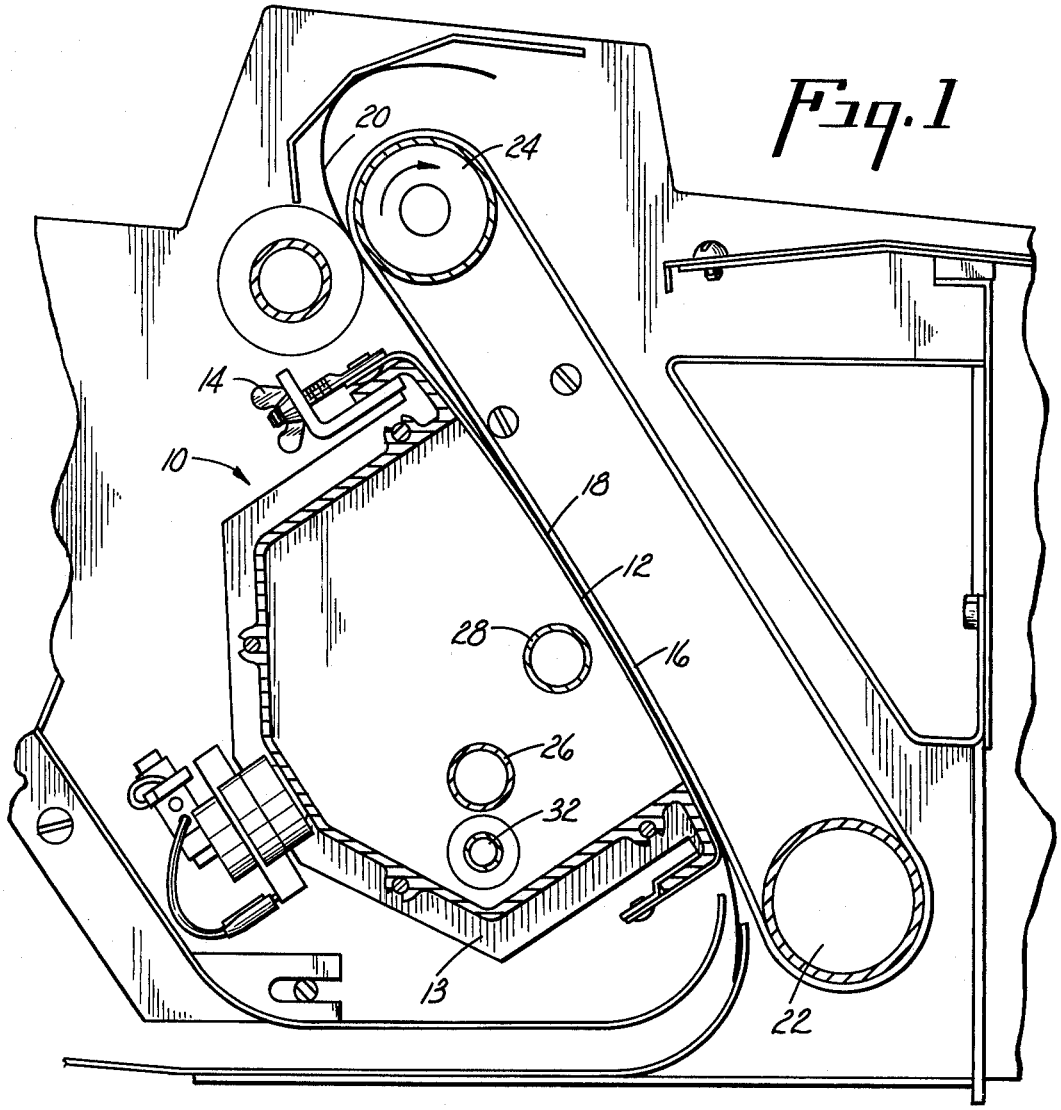
FIG. 1 is an end elevation, partially in section, showing a photocopy developing apparatus in association with a copy sheet transport in accordance with the present invention.

As shown in FIG. 1, the developing apparatus comprises a substantially closed developer tank indicated generally by the reference numeral 10. The developer tank is provided with an open side which is covered with a perforated sheet or screen of polytetrafluoroethylene 12 fastened to the developer tank as with fastening means 14. The screen 12 is arranged so as to provide an arcuate surface adapted for contact engagement with a sealing sleeve or endless belt 16 to provide between the sealing sleeve 16 and the screen 12 a developing station 18 for developing a diazotype copy sheet 20 as it is transported through the developing station by the sealing sleeve 16.

Figure 2:
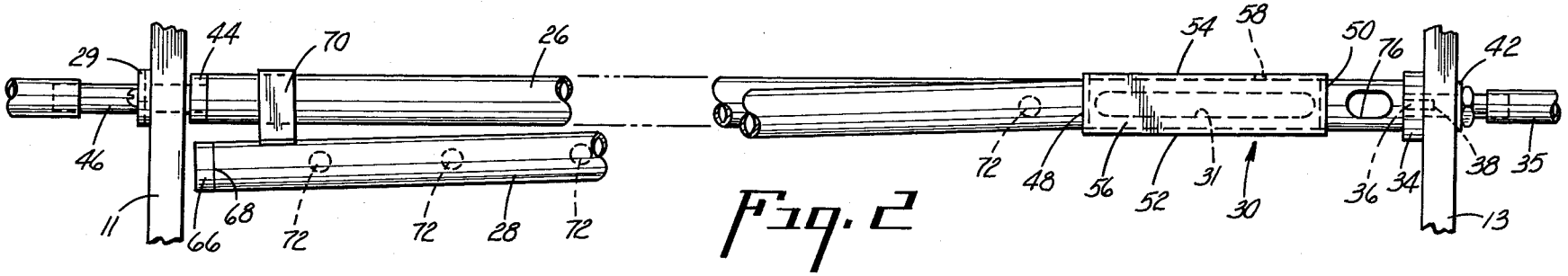
FIG. 2 is a plan view of the developing apparatus.
Figure 3:
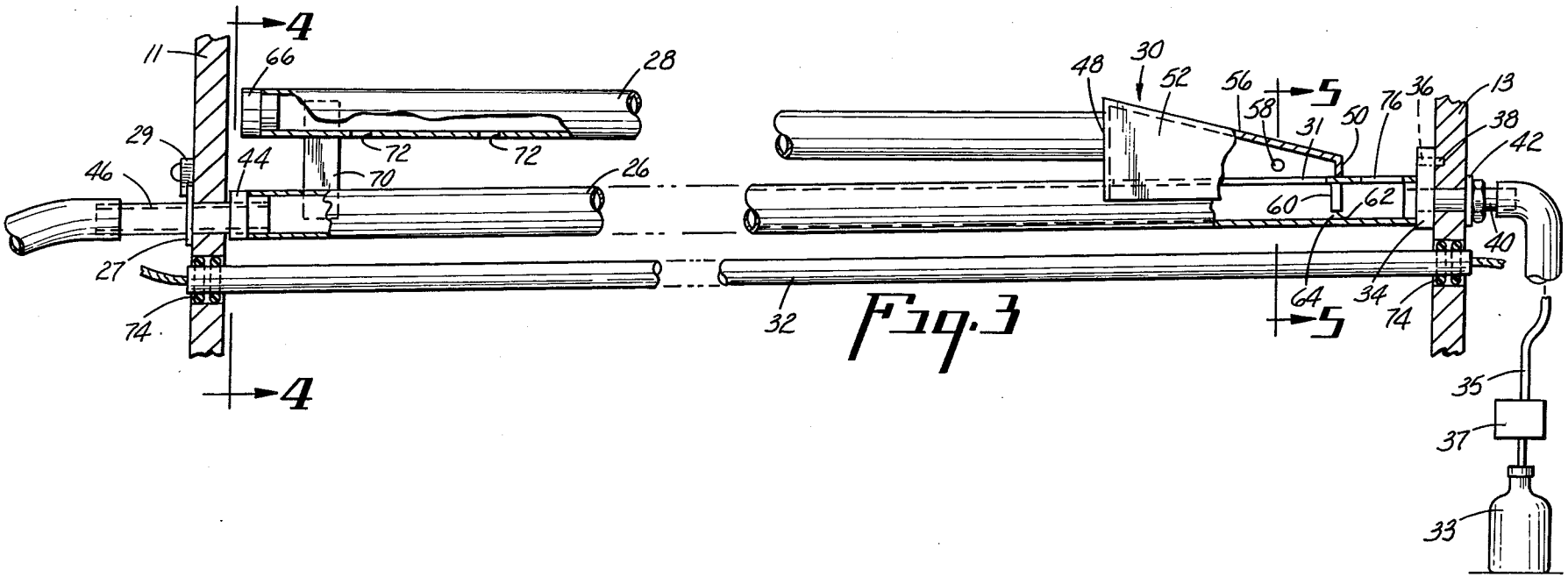
FIG. 3 is a front elevation, partially in section, including an ammonia supply system.

The developer tank 10 may be fabricated as an aluminum extrusion with cast aluminum end plates 11 and 13 as shown in FIGS. 1, 2 and 3, and the inside of the developer tank may be coated with epoxy or the like which is resistant to attack by chemically reactive materials such as ammonia. The sealing sleeve 16 is of conventional structure and covers the entire area of the screen 12 on the developer tank 10. The sealing sleeve is supported on a driven shaft 22 and is tensioned on a shaft 24. The driving of the sealing sleeve 16 is synchronized through a suitable sprocket and chain drive to the copying machine, not shown in the drawing.

FIGS. 2 and 3 illustrate in detail the developing apparatus of the invention mounted within the developer tank 10. The developing apparatus comprises a duct element or feed tube 26, a distribution element or tube 28, a manifold 30 and a heater element 32. The feed tube 26 provides a first path and extends from an ingress end provided with an inlet plug assembly 34 secured thereto as by welding. The inlet plug assembly 34 is provided with a pin 36 positionable in a blind hole 38 provided in the end plate 13 for supporting the ingress end of the feed tube 26. A feed-in connector 40 is mounted in the inlet plug assembly 34 and projects outwardly through a suitable opening provided in the end plate 13 to provide an inlet passage for aqueous ammonia flow into the feed tube 26. The feed-in connector 40 also includes a gasket means 42 to prevent leakage of ammonia or escape of ammonia fumes in the area of the feed-in connector 40 extending through the end plate 13.

Figure 4:
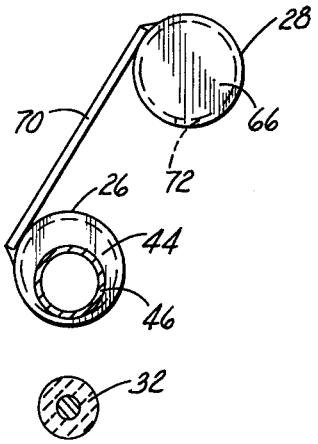
FIG. 4 is an enlarged section taken on the line 4—4 of FIG. 3.

The other end or the egress end of the feed tube 26 is provided with a discharge plug assembly 44 secured thereto as by welding. A feed-out connector 46 is mounted in the discharge plug assembly 44 and projects outwardly through a suitable opening provided in the end plate 11 for supporting the feed tube 26 in the end plate and for providing a discharge exit for passage of residue waste from the feed tube 26. As shown in FIG. 3, the feed-out connector 46 is supported in the end plate 11 such that its axis is positioned at a level lower than the level of the axis of the feed-in connector 40 supported in the end plate 13. In this way, the feed tube 26 extends at a decline from the ingress end of the feed tube to the egress end thereof to permit gravity flow of the aqueous ammonia in the first path from the ingress end towards the egress end of the feed tube 26. Also, as shown in FIGS. 3 and 4, the axis of the feed-out connector 46 is below the axis of the feed tube 26 to permit drainage of substantially all of the residue waste from the feed tube. As shown in FIG. 3, the feed-out connector 46 is also provided with a gasket means 27, held in place by a retainer plate 29, to prevent escape of ammonia fumes from the developer tank 10 in the area of the feed-out connector 46 extending through the end plate 11.

With reference to FIGS. 2 and 3, the feed tube 26 is also provided with a cut-out section or elongate slot 31 at its ingress end extending substantially the length of the manifold 30 which is welded in place in a position above the slot 31. The manifold 30 comprises end walls 48 and 50, side walls 52 and 54 and a top wall 56. The end wall 48 is provided with an opening for supporting an ingress end of the distribution tube 28 at a position above the feed tube 26, and the manifold 30 is secured above the cut-out section 31 by welding the end walls 48, 50 and the lower edges of the side walls 52, 54 (see FIG. 5) to the feed and the distribution tubes 26 and 28 respectively. Further, the side wall 54 is provided with a port 58 for expelling ammonia gas from the manifold 30 during the travel of the ammonia gas from the feed tube 26, through the slot 31 to the distribution tube 28, as will be further explained hereinafter.

Figure 5:
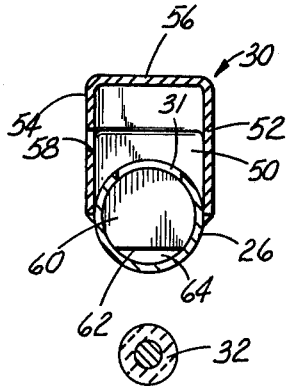
FIG. 5 is an enlarged section taken on the line 5—5 of FIG. 3.

As shown in FIGS. 3 and 5, the apparatus also includes a gate means 60 in the form of a disc, secured to the end wall 50 of the manifold 30 as by welding, substantially enclosing the inside diameter of the feed tube 26. The periphery of the gate means 60 is provided with a flat 62 extending perpendicular to the vertical axis of the feed tube 26 to provide a gap 64 between the flat 62 and the lower inside wall of the feed tube 26. The gate means 60 is effective to permit passage of aqueous ammonia through the gap 64 into the feed tube 26, but prevents passage of ammonia gas in the opposite direction.

As shown in FIGS. 2 and 3, the distribution tube 28 provides a second path for the ammonia gas flow and extends from the ingress end secured to the manifold 30 to an end provided with a plug 66 which provides a closed end 68 terminating adjacent the inside face of the end plate 11. The distribution tube 28 is positioned above and slightly transverse to the feed tube 26 and is arranged at an incline from its ingress end to its closed end 68, to thereby position the distribution tube 28 somewhat centrally within the developer tank 10 to provide for even distribution of the ammonia gas. The distribution tube 28 is retained in this position by a strap 70 welded to the outside walls of the feed tube 26 and the distribution tube 28 at a position near the egress and closed ends of the tubes respectively, as shown in FIGS. 2, 3 and 4. The distribution tube 28 is also provided with a plurality of ports 72 of discrete placement and size for expelling ammonia gas from the distribution tube 28 in a direction downwardly towards the feed tube 26.

The feed tube 26, distribution tube 28, manifold 30 and all other components such as the connectors and plug assemblies which are exposed to the ammonia are preferably made of stainless steel or other suitable material which is impervious to attack by chemically reactive materials such as ammonia.

The heater element 32 is shown in FIG. 3 and comprises a 500 watt quartz heater of circular cross section supported in suitable openings provided in the end plates 11 and 13 provided with a seal means or O-rings 74 to prevent escape of ammonia fumes from the developer tank and, also, to afford to the heater element 32 a floating action to prevent possible damage to the heater element as a result of expansion caused by heat.

Although not shown in detail in the drawing, the aqueous ammonia may be supplied to the developer apparatus in any conventional manner as, for example, with a pump 37 for pumping the aqueous ammonia from an ammonia supply container 33 to a conduit 35 connected to the feed-in connector 40 of the feed tube 26, as shown in FIG. 3. A pump system for supplying and metering the ammonia delivered to the developer apparatus is disclosed, for example, in U.S. application Ser. No. 667,865, filed Mar. 17, 1976, now U.S. Pat. No. 4,023,592, issued May 17, 1977, and assigned to the assignee of the present invention.

In the operation of the apparatus of the present invention, 26° Baume ammonia is delivered by the pump 37 from the supply container 33 to the feed-in connector 40 at the ingress end of the feed tube 26, and the ammonia travels by gravity in a first path towards the egress end of the feed tube 26. The aqueous ammonia is initially at room temperature upon entering the feed tube 26 but immediately starts warming up as a result of the heater element 32 located directly below and extending the full length of the feed tube 26.

Upon entry of the aqueous ammonia into the feed tube 26, a small amount of ammonia gas is immediately liberated to the developer tank 10, via a pressure relief opening 76 provided in the upper wall of the feed tube 26, as a result of ammonia travel and heat rise. The pressure relief opening 76 ensures that no pressure build-up is reflected back into the ammonia pump system supplying the aqueous ammonia to the developer apparatus.

The aqueous ammonia supplied to the feed tube 26 travels through the gap 64 of the gate means 60 which, as mentioned above, allows aqueous ammonia flow into the first path but restricts ammonia gas flow in the reverse direction. As the aqueous ammonia continues to travel towards the egress end of the feed tube 26 (from right to left as viewed in FIG. 3) it continues to be heated thereby evaporating or separating the aqueous ammonia by driving the ammonia gas out of the aqueous ammonia. Subsequently, as the aqueous ammonia continues to be heated in its travel in the first path, substantially all of the ammonia gas is separated or driven off from the aqueous ammonia.

As the ammonia approaches the egress end of the feed tube 26 the temperature rises above 212° F. thereby further separating the ammonia by vaporizing the water content therein and driving off steam. The steam is predominately near the egress end of the feed tube 26 and is precluded from traveling in the opposite direction and entering the developer tank 10 because of the high pressure area of ammonia at the other or the ingress end of the feed tube 26. If some small amount of steam were to travel towards the ingress end of the feed tube 26 it would quickly condense, due to the lower temperature of the feed tube at its ingress end which is cooled by the 26° Baume ammonia entering the feed tube at room temperature, and travel to the egress end and exit from the feed tube 26.

The apparatus of the invention provides for effectively separating the aqueous ammonia into a first portion of residue waste comprising hot water and a slight trace of ammonia, and a second portion comprising ammonia gas and steam utilized for development of the diazo copy material. Because the ingress end of the feed tube 26 is pressurized with a high ammonia concentration, while the egress end of the feed tube is pressurized with a high steam concentration, the egress end of the feed tube 26 is relieved by exiting the first portion via the feed-out connector 46 to a suitable residue waste eliminator. A device for eliminating the waste exiting from the developer apparatus is disclosed, for example, in copending U.S. application Ser. No. 700,408, filed June 28, 1976, and assigned to the assignee of the present invention.

The ingress end of the feed tube 26 is relieved as a result of the second portion or ammonia gas traveling from the first path to a lower pressure area in the developer tank 10 via the manifold 30 which directs the ammonia gas from the feed tube 26 to the second path in the distribution tube 28. The ammonia gas enters the ingress end of the distribution tube 28 and travels towards the closed end 68 thereof. The ports 72 in the distribution tube 28, and the port 58 in the side wall 54 of the manifold 30, expel the ammonia gas uniformly to generate an even distribution of gaseous ammonia throughout the developer tank 10. Thus, as a diazo copy sheet 20 is delivered to the developing station by the sealing sleeve 16 as shown in FIG. 1, the gaseous ammonia atmosphere within the developer tank 10 exits through the screen 12 and impinges upon the copy sheet to develop the copy sheet with an image of high fidelity.

From the foregoing, it will be appreciated that the invention provides a developer apparatus for developing diazotype copy material which provides for control of the moisture content to which the copy material to be developed is exposed, and uniform and controlled distribution of the gaseous ammonia within the developer tank, as a result of the feed and the distribution tubes confining the travel of the aqueous ammonia and the ammonia gas in separate controlled paths. Further, the separation of the aqueous ammonia into the first and the second portions in the feed tube provides for substantially complete utilization of the ammonia gas contained in the aqueous ammonia.

What is claimed is:

1. An apparatus for developing sensitized copy sheets, comprising:

a substantially closed developer tank;

duct means positioned wholly within the developer tank for receiving and conveying aqueous ammonia;

means for supplying aqueous ammonia to the duct means;

heating means positioned wholly within the developer tank for raising the duct means to an elevated temperature to separate the aqueous ammonia in the duct means into a first portion of residue waste and a second portion of ammonia gas;

distribution means positioned wholly within the developer tank for receiving and conveying the second portion; and means for expelling the second portion from the distribution means to generate a gaseous ammonia atmosphere within the developer tank.

2. An apparatus as set forth in claim 1 further comprising means for discharging the first portion from the duct means.

3. An apparatus as set forth in claim 1 further comprising manifold means for directing the second portion from the duct means to the distribution means.

4. An apparatus as set forth in claim 1 in which the means for supplying aqueous ammonia to the duct means includes a pump means, and the duct means comprises pressure relief means to prevent pressure build-up of the aqueous ammonia in the pump means.

5. An apparatus as set forth in claim 1 in which the duct means has an ingress end to which aqueous ammonia is supplied and an egress end from which the first portion is expelled, said duct means being positioned at a decline from the ingress end to the egress end.

6. An apparatus as set forth in claim 1 in which the distribution means extends from an ingress end for receiving the second portion to a closed end, said distribution means being positioned above and transverse to the duct means at an incline from the ingress end to the closed end.

7. An apparatus as set forth in claim 1 in which the means for expelling the second portion from the distribution means comprises a plurality of port means provided in the distribution means.

8. An apparatus as set forth in claim 1 further comprising gate means provided in the duct means to permit passage of aqueous ammonia therethrough in one direction by gravity and to prevent passage of the second portion therethrough in the opposite direction.

9. An apparatus as set forth in claim 1 in which the heating means comprises a quartz heater element positioned within the developer tank below and in spaced parallel relation with the duct means.

10. An apparatus for developing sensitized diazo-type copy sheets delivered to a developing station, comprising:

a substantially closed developer tank having perforated means adjacent the copy sheet developing station;

duct means lying in a first plane wholly within the developer tank for receiving aqueous ammonia and conveying the same by gravity from an ingress end of the duct means towards an egress end of the duct means;

means for supplying aqueous ammonia to the ingress end of the duct means;

heater means within the developer tank for heating the duct means to an elevated temperature for separating the aqueous ammonia in the duct means into a first portion of residue waste which is discharged at the egress end thereof, and a second portion of ammonia gas;

distribution means lying in a second plane spaced from the first plane and wholly within the developer tank for receiving the second portion from the duct means and conveying the same from an ingress end of the distribution means;

manifold means associated with the ingress ends of the duct and the distribution means for directing the second portion from the duct means to the distribution means; and port means provided in the distribution means and the manifold means for expelling the second portion therefrom to generate a gaseous ammonia atmosphere within the developer tank which exits through the perforated means for developing a copy sheet at the developing station.

11. A method of developing sensitized copy sheets, comprising the steps of:

conducting aqueous ammonia in a generally downwardly reclining first path;

heating the aqueous ammonia to an elevated temperature during said conducting for separating the aqueous ammonia into a first portion of residue waste and a second portion of ammonia gas;

conducting the second portion in a second path lying in a plane spaced from the plane of said first path; and expelling the first portion from the first path and the second portion from the second path to generate a gaseous ammonia atmosphere substantially free of residue waste.

12. A method as set forth in claim 11 comprising the further step of gating the first path to permit passage of aqueous ammonia therethrough in one direction and to prevent passage of the second portion therethrough in the opposite direction.

* * * * *